US006196420B1

(12) United States Patent
Gutierrez et al.

(10) Patent No.: US 6,196,420 B1
(45) Date of Patent: Mar. 6, 2001

(54) PUMPLESS DISPENSER FOR VISCOUS FOOD PRODUCTS

(75) Inventors: Antonio Gutierrez, Kent; Randall Chrisman, Southbury, both of CT (US)

(73) Assignee: Nestec S.A., Vevey (CH)

( * ) Notice: Subject to any disclaimer, the term of this patent is extended or adjusted under 35 U.S.C. 154(b) by 0 days.

(21) Appl. No.: 09/392,463

(22) Filed: Sep. 9, 1999

(51) Int. Cl.[7] ..... B65D 35/28
(52) U.S. Cl. ..... 222/101
(58) Field of Search ..... 222/95, 105, 101, 222/181.1, 181.2, 181.3

(56) References Cited

U.S. PATENT DOCUMENTS 1,556,437 * 10/1925 Granger ..... 222/101
2,543,667 * 2/1951 Palmer ..... 222/101
2,570,755 * 10/1951 Booth ..... 222/101
2,837,243 * 6/1958 Zebink ..... 222/101
2,936,006 * 5/1960 Henley ..... 222/101
4,223,809 * 9/1980 Martin ..... 222/101
4,921,139 * 5/1990 Fisher et al. ..... 222/129.1
5,292,031 * 3/1994 Dagan ..... 222/105
5,634,343 * 9/1980 Baker, III ..... 222/146.6

* cited by examiner

*Primary Examiner*—Kevin Shaver
*Assistant Examiner*—David A. Bonderer
(74) *Attorney, Agent, or Firm*—Pennie & Edmonds LLP

(57) ABSTRACT

A pumpless dispenser especially intended for dispensing viscous fluids. The dispenser includes a supple pouch having first and second ends, a sidewall that can be arranged to form first and second opposed surfaces, and an outlet. The pouch contains a viscous fluid food product therein. The dispenser also includes a housing configured and dimensioned for receiving the pouch; and a compression assembly for pressing the pouch so as to urge the viscous fluid food product content toward the outlet. This assembly includes a roller having a pressing surface disposed adjacent the first surface of the pouch and a planar surface disposed adjacent the second surface of the pouch. The dispenser further includes a closure member engaged with the outlet for closing the outlet. This member is capable of opening the outlet so as to cause the roller to move along the pouch surface toward the outlet by gravity for expelling the viscous fluid food product through the outlet. The dispenser is suitable for viscous food products with or without particles, such as sauces, gravies and the like.

27 Claims, 17 Drawing Sheets

PUMPLESS DISPENSER FOR VISCOUS FOOD PRODUCTS

FIELD OF THE INVENTION

The present invention relates to a dispenser of a type adapted for dispensing food products, more particularly viscous fluids. The dispenser belongs to the category of pumpless dispensers comprising a supple bag forming a removable and exchangeable part of the dispenser.

BACKGROUND OF THE INVENTION

In the food service industry, it is desirable to serve a wide variety of viscous fluids such as sauce, mustard, ketchup, condiments, and the like in hygienic conditions and as conveniently as possible. For that, there are several known types of dispensing devices which utilize both the gravity and the mechanical force to dispense viscous fluids throughout a tube connected to a bag. Such dispensing apparatuses generally do not require any additional pumps.

For example, U.S. Pat. No. 5,833,120 to Evans, Sr. et al. discloses a cheese server being adapted to maintain inverted bags in a steam chamber while gravity influenced squeeze bars ride down the bag sides to express cheese toward the bag outlet fitment. Such an arrangement remains rather complicated and inconvenient when the bag has to be changed by a new one. In particular, the pair of rollers has to be detached from the empty bag, then fitted to a new bag while taking care the rollers are not biased with respect to the bag which would cause blocking problems. In addition, when the bag is loaded with fluid product, it may be difficult to properly engage the pair of rollers through the upper portion of the bag.

U.S. Pat. No. 5,490,613 to Taylor et al. relates to a dispenser for viscous fluid having a hanging assembly for suspending a collapsible bag with a dispenser outlet extending from an opening at the bottom of a housing, and a pair of rollers riding in parallel pairs of slots vertically extending in opposite sides of the housing. In this arrangement, the device also comprises a pair of rollers which can be separated when the housing is opened for engaging a new bag. However, the device is cumbersome as place for the two rollers must be saved accordingly. The rollers have to be joined by an elastic yoke provided on each external side of the housing making the arrangement complicated. Blocking problems are likely to occur, as the two rollers might not ride in a perfect parallel travel all along the length of the bag.

U.S. Pat. No. 5,297,699 to Barchus also relates to an internally-coupled dual roller tube squeezing device for fluid materials such as toothpaste, shampoo, adhesive, or similar.

U.S. Pat. No. 4,639,251 to Kirland relates to a flexible collapsible container containing medical liquids, a pair of rollers being arranged as a level indicator.

U.S. Pat. No. 5,578,001 to Sha is an infusion apparatus for IV bags comprising a squeezing arrangement of two parallel rollers.

None of the devices discussed above provides a satisfactory solution that can be applied as a recognized efficient standard in the food service industry. Accordingly, there remains a need for improved dispensing devices in this area.

SUMMARY OF THE INVENTION

The present invention relates to a pumpless dispenser especially intended for dispensing viscous fluid food products. The dispenser includes a supple pouch having first and second ends, a sidewall that can be arranged to form first and second opposed surfaces, and an outlet. The pouch contains a viscous fluid food product therein. The dispenser also includes a housing configured and dimensioned for receiving the pouch; and a compression assembly for pressing the pouch so as to urge the viscous fluid food product content toward the outlet. This assembly includes a roller having a pressing surface disposed adjacent the first surface of the pouch and a planar surface disposed adjacent the second surface of the pouch. The dispenser further includes a closure member engaged with the outlet for closing the outlet. This member is capable of opening the outlet so as to cause the roller to move along the pouch surface toward the outlet by gravity for expelling the viscous fluid food product through the outlet.

The present invention provides a new pumpless dispensing unit which is low cost, more convenient to maintain than previous state-of-the-art dispensers and easy to use by the consumer. In particular, empty bags can be replaced by new ones with less manipulation and more reliability. The time for changing the bag is reduced and this is very valuable during peak hours in food service establishments. The risks of blocking problems of the device are also reduced.

The types of viscous fluid food products that can be dispensed from this dispenser include cheese sauce, tomato sauce, gravy, salad dressing, mustard, mayonnaise, ketchup, cream, Mexican sauce or salsa, condiment, nutritional supplement and concentrate, ice cream, or even partly frozen beverages. The invention also dispenses the product at a relatively high efficiency with less loss of food products in the bag and a higher controlled level of extrusion of the food product. Furthermore, the device can accommodate a wide range of pouch thicknesses while still exerting an effective squeezing pressure thereon.

Additional advantages are provided when the food product to be dispensed is to be heated or cooled. The dispensing device provides a rapid and economic warm-up of the food products for those which require to be served warm and, similarly, a rapid and economic cooling of the food products which are required to be served as chilled or partly frozen products.

BRIEF DESCRIPTION OF THE DRAWINGS

The advantages and specific features of this invention will become apparent from a review of the following detailed description, which is provided in conjunction with the appended drawing figures, which disclose preferred embodiments of the present invention, and wherein.

DETAILED DESCRIPTION OF THE PREFERRED EMBODIMENTS

Figure 1:
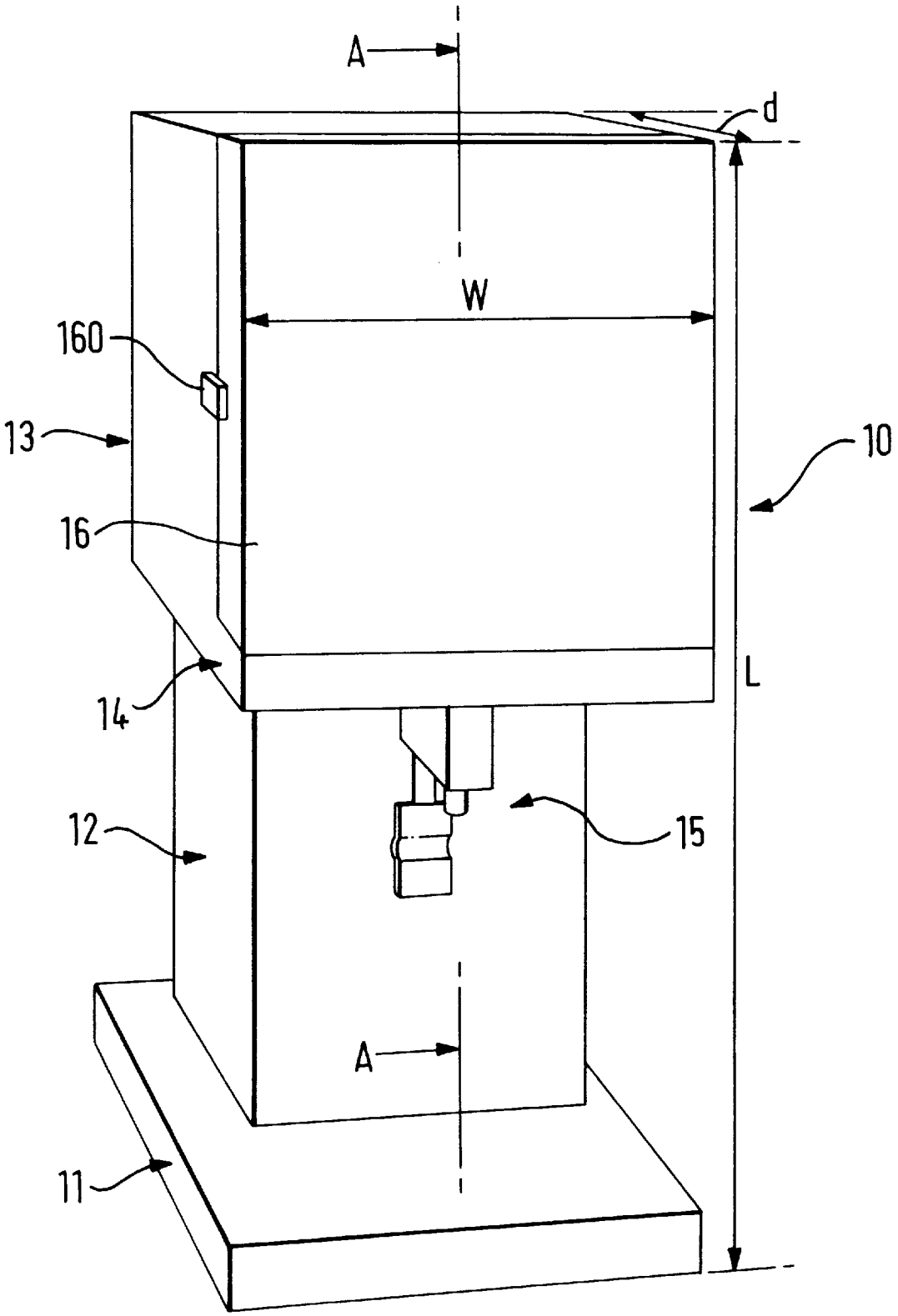
FIG. 1 is a perspective representation of the pumpless food dispenser according to the concept of the present invention.

As noted above, the invention relates to a dispenser for fluids, and particularly for viscous fluid food products. This dispenser comprises a supple pouch comprising fluid food and an outlet, a housing for receiving the pouch, means for pressing the pouch so as to expel the viscous fluid food product toward the outlet, the means comprising a roller disposed adjacent a first surface of the pouch and a planar surface disposed adjacent a second surface of the pouch opposite to the first surface of the pouch, closure means engaged with the outlet and capable of opening the outlet so as to cause the roller to move along the bag by the influence of gravity force for extruding a quantity of fluid foods through the outlet.

Therefore, the system of the invention is more reliable as a single roller acts upon the pouch supported by a planar surface. The planar surface provides an appropriate and solid support to permit a good and complete emptying of the pouch with reduced loss of product in the pouch after the passage of the roller. The planar arrangement in support of the pouch also confers a consistent and homogeneous pressure on the pouch all over the roller's travel. Disengaging of the pouch from the pressure means is furthermore facilitated.

In one embodiment, the planar surface is substantially vertically arranged along at least a major portion of the length of the pouch. In a preferred embodiment, the planar surface constitutes an interior surface of at least a portion of wall of the housing. This arrangement is so less cumbersome as the portion of wall can be made significantly thinner than an additional weighted roller. This arrangement is also supposedly lighter than the state-of-the-art dispensers are. This arrangement is less subjected to blocking problems as the number of moving parts is reduced.

In a more preferred embodiment, the housing comprises an openable front door; the portion of wall comprising the planar surface is at least a portion of the door. Therefore, the system can be deactivated and reactivated by simply manipulating the door in order to change the pouch and replace it by a new one. The maintenance is so limited to a minimum thus saving labor time and improving reliability of the dispenser. In addition, the thickness of the pouch is no more a concern as the device is able to absorb a wider range of thickness than the state-of-the-art dispensers.

Another preferred embodiment of the invention has the roller guided along two guide means disposed along each side of the pouch, the roller having two side portions closely engaged with the guide means. Such an arrangement ensures that the roller is properly driven during its travel along the pouch while greatly reducing the risks of biasing. The arrangement also does not disturb the ease of replacement of the pouch when emptied as the guide means are properly located outside the contour of the pouch.

In an another preferred embodiment, the guide means are disposed at a certain distance parallel to the plate surface causing the roller to constantly apply a force upon the bag against the plate surface. This arrangement also participates to a reliable dispensing system with no lack of pressure on the pouch. Depending upon the pouch range of thickness, the distance may vary accordingly.

In a more specific configuration of the invention, the guide means may comprise two gear tracks along which are positively arranged two gearing cylindrical portions forming the two side portions laterally protruding from the pressing surface of the roller. Preferably, the roller is positioned in a freely rotating arrangement along the two gear tracks without connection means. Thus, the roller can be easily manipulated when the pouch is changed. This also participates to the general simplification of the device which has the advantage to limit the technical problems and favors the ease of maintenance.

The closure means advantageously comprises a clamping assembly for selectively pinching the outlet of the pouch and releasing pinching to control the dispensing of the viscous liquid food product. Therefore desired quantity of food dispensed is achieved by actuation of the closure means. The opening of the closure means will start the roller motion along the pouch.

The dispensing clamping assembly advantageously comprises a first half-valve sub-assembly attached to an openable portion of wall of the housing and a second half-valve sub-assembly attached to a fixed portion of wall of the housing; each sub-assembly comprising one pinching member, the pinching members being arranged together in a face-to-face relation-ship when the openable portion is in closure position. The openable portion of the housing is advantageously a front panel of the dispensing device. The benefits of the self-disengaging of the valve or clamping means during opening are that the interior of the dispensing device can be more easily cleaned, repaired and the change of pouch is rendered much easier. In particular, the pressure on the outlet of the pouch is automatically released upon opening of the dispensing device so that no further manipulation on the clamping means is necessary and the pouch can be removed more easily.

In another preferred embodiment, the housing further comprises a pair of guiding slots which are substantially vertically oriented and the roller comprises a pair of axles slidably engaged through the pair of guiding slots when the roller moves downwardly along the pouch. Therefore, the roller is more accurately guided and manipulation of the roller is rendered possible with no need to open the housing.

Preferably, the pair of guiding slots extends upwardly by hook-shaped extensions which confer a stable rest position for the roller. Thus, the roller can be positioned in a rest position before the housing is opened, for example, before replacement of the pouch or maintenance of the dispenser.

The roller may be secured at an upper start position in the housing by means of a release mechanism which comprises a resiliently urged lever having an externally protruding portion and an enlarged base portion against which the roller abuts. Therefore, the roller can be maintained in an upper start configuration and only actuated manually while the device is closed.

According to one interesting aspect of the planar arrangement of the pressing means, the planar surface may be advantageously thermally coupled to a conductive heating or cooling device which provides thermic transfer to the planar surface for heating or cooling the food product in the pouch. The planar surface constitutes a significant surface of contact for the pouch which favors the thermic transfers so as to reduce calorific or frigorific loss and accelerate warm-up or cooling of the food product.

Preferably, the planar surface is coupled to a heating device comprising electrical resistance elements attached to the planar surface. More preferably, the heating device is adhesively secured on one side of the planar surface. The heating device may comprise adhesive strips or bands and electrical resistance elements connected therewith such as wires, mat or equivalents.

In another embodiment, the heating device also comprises convection means attached to the housing which provide heating by hot air circulating within the housing.

In an even more preferred embodiment, the air-forced convection heating means are used as primary source of heat in the dispenser and the conduction heating means are coupled to the planar surface as a supplementary source of heat to ensure a faster warm-up of the food product in the dispensing device.

In yet another embodiment, the dispenser comprises a cooling device using cold air-forced convection which can be used either alone or, even preferably, in combination with a supplementary thermoelectric cooler coupled to the planar surface.

The invention also relates to the pouch especially adapted for being used in the dispenser of the invention. The pouch comprises a main portion adapted for receiving a viscous fluid food product, and an outlet portion integrally extending from the main portion. The main portion and the outlet portion are formed of at least one layer of flat plastic film securely sealed along at least a portion of a peripheral seam in a substantially flat configuration. This arrangement of fitmentless pouch provides a uniform purge upon the passage of the unique roller while leaving a minimum remainder of food product within the pouch. The pouch can also be produced in a cost-effective manner by the commonly known method of form-fill-seal technique.

A viscous fluid dispenser according to the present invention is generally indicated by the reference numeral 10 in FIG. 1. As shown, dispenser 10, many of whose components can be molded of polymeric material, includes a pedestal 11, a stanchion portion 12 extending vertically from near the rear of the pedestal, and a main housing 13 comprising the different functional components of the dispenser. The stanchion portion 12 and the housing may be made integral or be assembled by any suitable affixation means, as well. The housing extends from the base of the stanchion portion to form a front projection 14 so as to provide space for dispensing means or closure means 15 using manual pressure of a glass, a cup or any other suitable container. It must be understood that other types of dispensing means can be used as well, as for example, a simple tap means.

The dispenser may be used in a wide variety of applications for dispensing generally food products. For the purpose of the invention, such food products are generally contemplated as including cheese sauce, tomato sauces, gravies, salad dressings, mustard, mayonnaise, ketchup, Mexican sauce or salsa, cream, condiments, nutritional supplements and concentrates, ice creams, partly frozen beverages (such as milk shake), etc. The food product can contain relatively small solid pieces approximately up to 12.7 mm in diameter in a viscous suspending matrix provided the extrusion of the product is still made possible by the dispenser. Preferably, the invention contemplates use of the dispenser assembly with food products having a viscosity generally in the range of from about 14 cm to about 27 cm as measured by the Bostwick method at 82° C.

The dispenser of the invention may be adapted for dispensing food products requiring at least intermittent cooling, refrigeration or warming. In these regards, suitable cooling, refrigerating or heating devices may be added to the dispenser in the more appropriate manner as later explained in the description.

Figure 2:
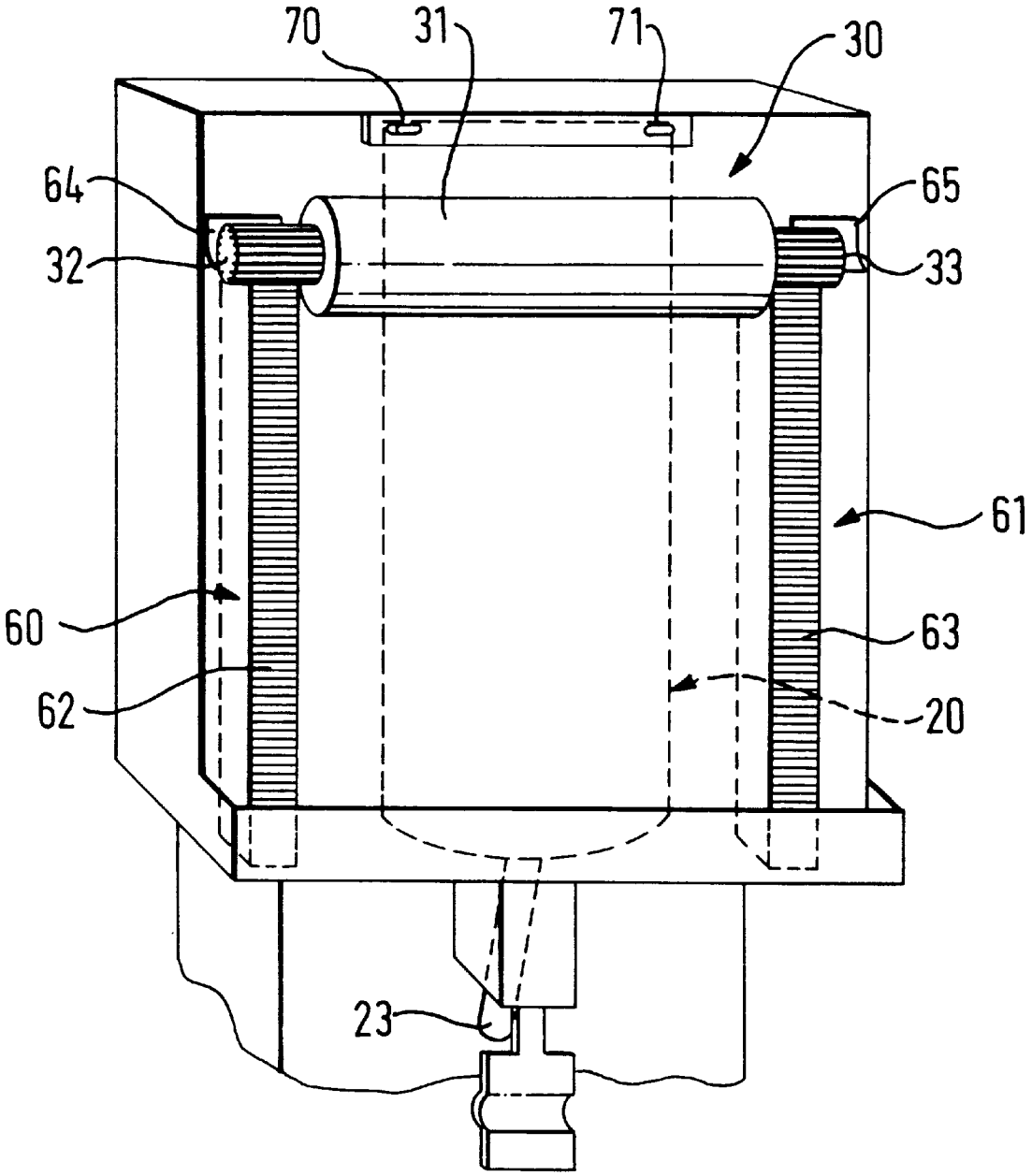
FIG. 2 is a partial perspective view of the dispenser showing the inside arrangement of the roller system with the pouch in dotted lines.
Figure 3:
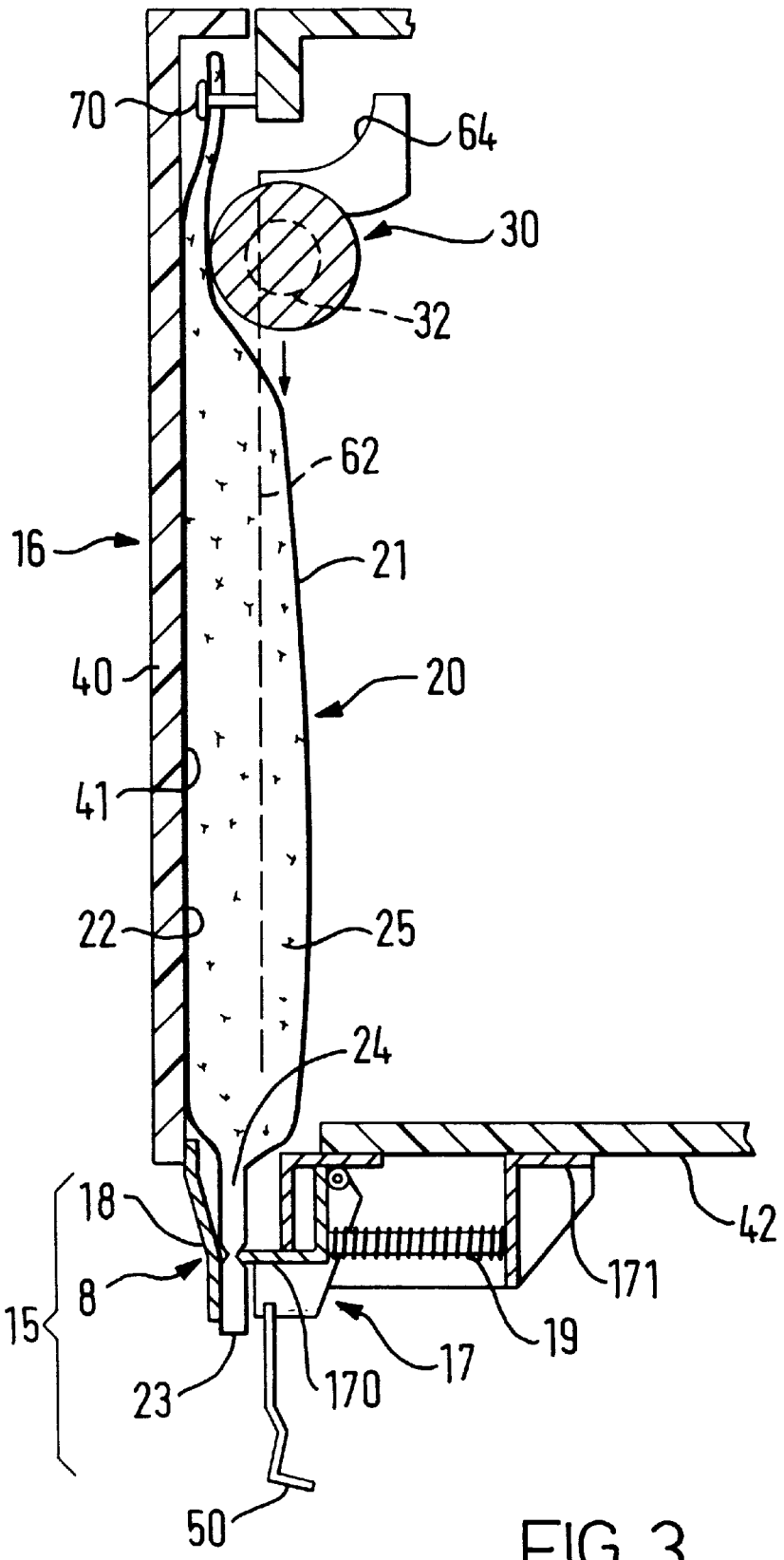
FIG. 3 is a partial cross-sectional view taken along line A—A of the dispenser of FIG. 1.

As shown in FIGS. 2 and 3, the dispenser comprises means for pressing a pouch 20 so as to provoke the extrusion of the food product by an outlet 23, generally positioned at the lower end of the pouch. These means comprise a unique roller 30 positioned adjacent a first surface 21 of the pouch. The means also comprise a portion of wall 40 of the housing which so provide an interior planar surface 41 upon which a second surface 22 of the pouch can take planar support. It must be noted that this simple arrangement can be installed in a very reduced space of the dispenser leaving more space for other devices such as heating devices or refrigerating devices or allowing to produce less cumbersome dispensers.

Preferably, the portion of wall 40 is at least part of the front door 16 of the dispenser which can be opened along properly arranged hinges located on one side of the housing while the other side may advantageously have a locking means 160. Of course, this specific construction may significantly vary depending the specific needs and types of dispensers. For example, the dispenser may be opened by more than one door or the doors may rotate along hinges located on the top or bottom of the housing.

Hanger means 70, 71 are provided on the top part of the housing to permit to suspend the pouch in proper vertically oriented position. The hanger means are located so that the pouch comes as close as possible to the planar surface. As shown, for example, the upper wall of the housing extends toward the interior of the housing by an edge comprising two hanging rods. The pouch comprises complementary reception means adapted to fit with the hanger means 70, 71. For example, a pair of complementary holes is provided in the top sealed part of the pouch.

As shown on FIG. 3, the outlet 23 of the pouch is pinched by a clamping assembly that is generally part of the closure means 15. The clamping assembly selectively engages a substantially narrowed portion 24 of the outlet by a resiliable pinching effect on the narrowed portion. The narrowed portion is, for example a tubular segment, protruding downardly form the main portion 25 of the bag which contains the food product to be dispensed. The clamping assembly 8 generally comprises a clamping member 17 on one side of the narrowed portion and an abutting member 18 on the other side of the narrowed portion. The two members are resiliably engaged with the portion 24. The clamping member 17 is urged against the outlet by means of resiliable means such as a spring 19. The spring is inserted between a rotating element 170 of the clamping member mounted on a body element 171 fixed with respect to the base 42 of the housing. The closure means further comprises a lever 50 attached to the rotating element 170 of the clamping member so that a sufficient pressure on the lever will compress the resiliable means 19 and consequently will cause disengagement of the clamping member from the outlet. In a more simple aspect, the closure means can also be replaced by a "clothes-pin" style valve or any similar simple elastic valve means.

Other suitable closure means could also replace the one described depending upon the specificity of the product to be dispensed. For example, a cheese sauce may require a different assembly with a simple tap member engaged with the outlet. In the proposed assembly, the lever is well adapted for receiving containers like glass or cups as the lever is pushed in rearward direction and the outlet is positioned in front of the lever. However, it may be suitable for other types of containers, such as plates, to be able to manually act on the lever by pulling the level rather than pushing and also so have the outlet at a certain distance of the lever.

Referring again to FIG. 2, the roller 30 comprises a main pressing portion 31 of relatively large diameter. The portion 31 is at least partially made of a heavy material, preferably, a high density metallic material, so as to reach a mass sufficient for completely emptying the pouch under the influence of gravity. The main portion 31 should be slightly larger than the pouch that is normally intended to fit the dispenser so as to make sure the food product cannot escape upwardly in the emptied portion of the pouch. Of course, the roller weight is dimensioned as a function of the viscosity of the product to be extruded. For example, a roller having a total mass of 900 grams will be suited to extrude a fluid having a viscosity ranging from about 14 cm to 27 cm as measured by the Bostwick method at 82° C.

The roller 30 is guided along two guide means 60, 61 disposed along each side of the pouch. The roller has two side portions 32, 33 engaging the guide means. The guide means are preferably two gear tracks 62, 63 having a vertical substantially linear configuration. The gear tracks are preferably parallel to each other. They are also spaced apart from the planar surface 41 and parallel to it so that a homogeneous pressure is applied onto the pouch (as illustrated in FIG. 3). One important aspect of the invention resides in the fact that the roller is mounted in a freely rotating arrangement with respect to the guide means. This means that there is no positive connection between the roller and the gear tracks. The roller can be manipulated more easily. For that, upper seats 64, 65 having curved shapes extend from the gear tracks to form starting ramps on which the side portions of the roller can rest in position before closing the housing. Preferably, the gear tracks and the complementary shaped gear portions of the roller are made of a relatively durable and rigid polymeric material. However, these elements could also be made of metal or any other suitable material.

It is important to note that this general construction participates to a significant reduction of the maintenance time compared to the known devices in the food service industry. As maintenance, we mainly intend the operation of replacing the pouch by a new one when emptied. However, other usual operations may be carried out such as cleaning, repairing, etc., that are generally also rendered simpler and less time consuming.

Figure 5:
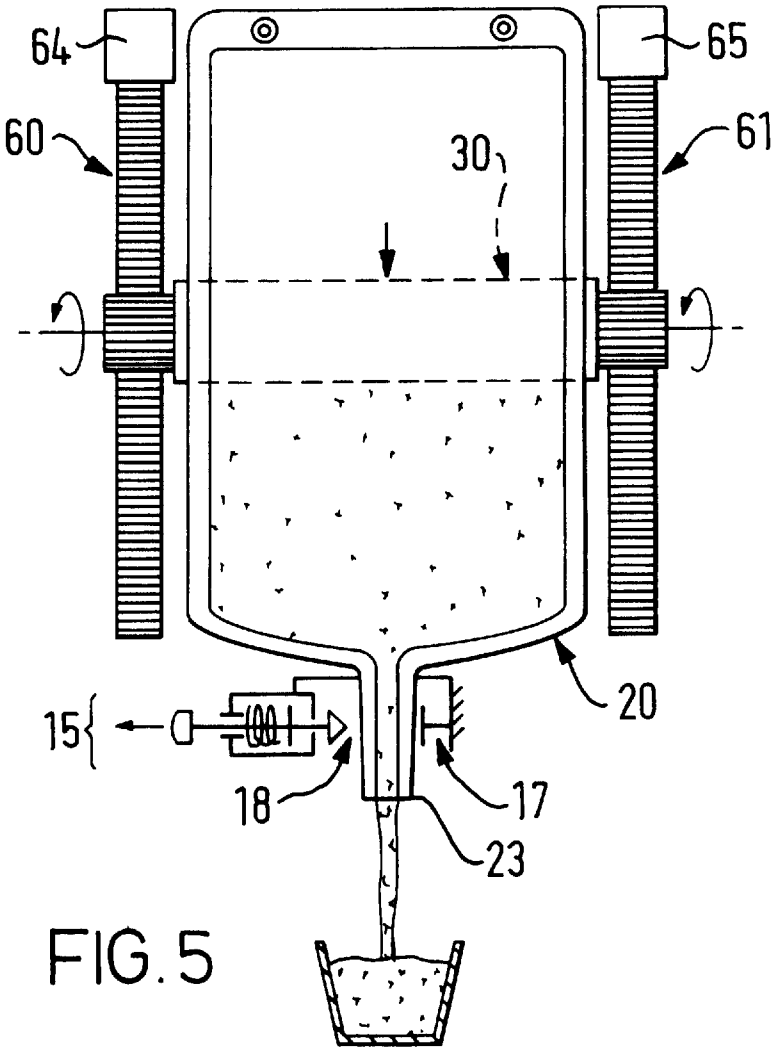
FIG. 5 is a schematic front view of the dispensing assembly during the dispensing phase.
Figure 4:
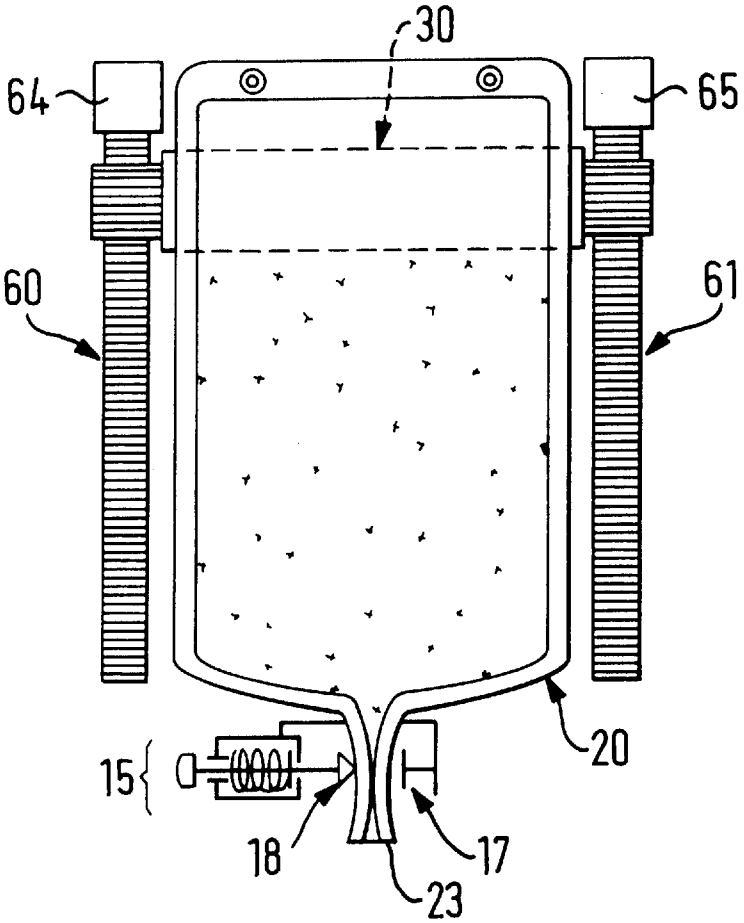
FIG. 4 is a schematic front view of the dispensing assembly before the dispensing phase.
Figure 6:
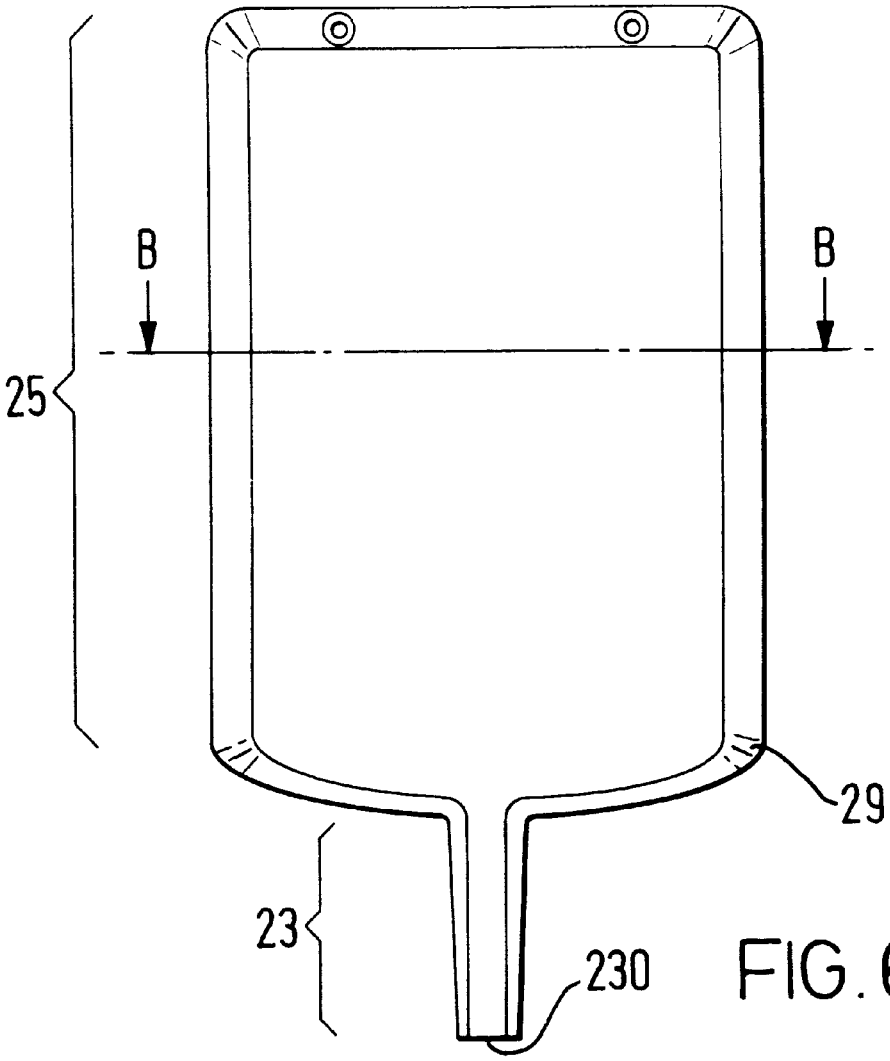
FIG. 6 is a front view of an empty pouch adapted for use with the dispenser of the present invention.
Figure 7:
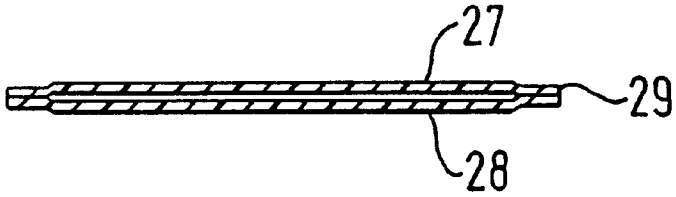
FIG. 7 is a cross-sectional view of the pouch taken along B—B of the pouch of FIG. 6.
Figure 8:
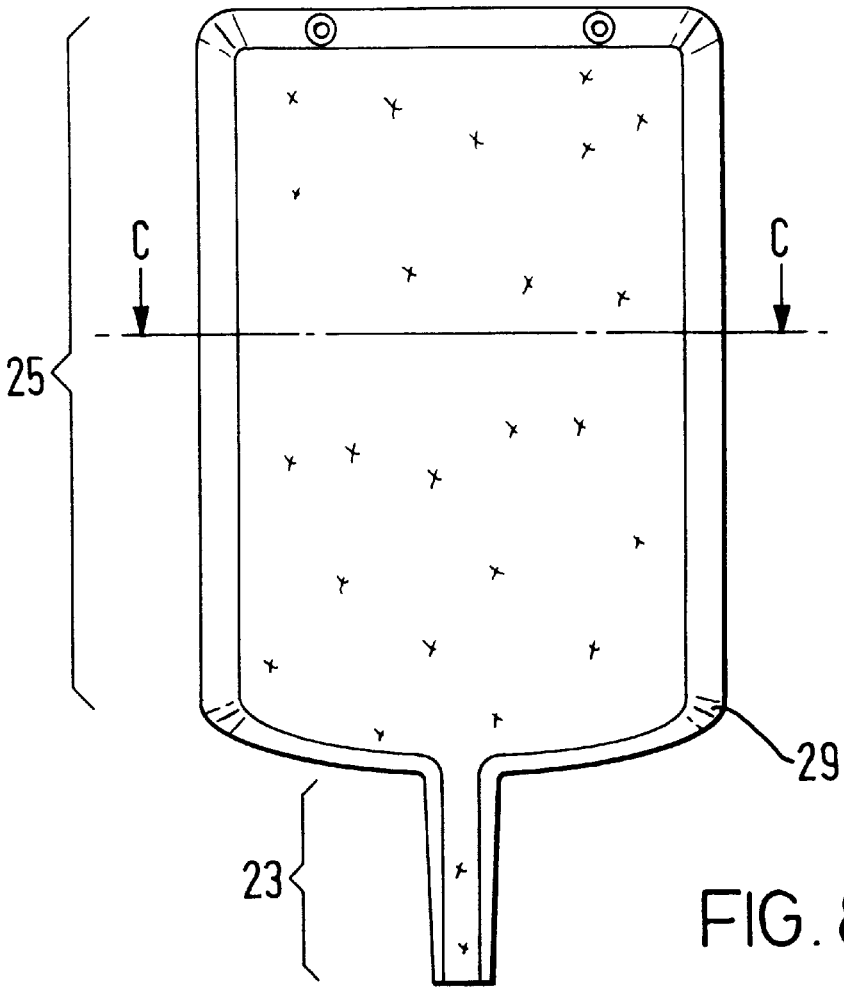
FIG. 8 is a front view of a pouch of the invention comprising food product.
Figure 9:
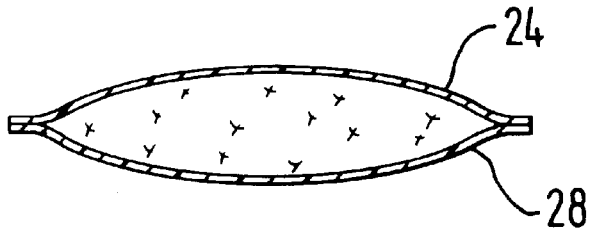
FIG. 9 is a cross-sectional view of the pouch taken along C—C of the pouch of FIG. 8.

FIGS. 4 and 5 illustrate the basic principle of the dispensing device of the invention. FIG. 4 shows the device in a position where the closure means 15 is closed; i.e., the clamping member 18 and abutting member 17 applying a pinching effect on the outlet. In that case, the roller is stopped by the fluid mass contained in the lower part of the pouch. In response to actuation of the closure means 15 illustrated by FIG. 5; i.e., the clamping member being disengaged from the outlet, the roller will rotate along the gear tracks while applying a sufficient pressure to cause the food product to pour through the outlet of the pouch. The flow rate can be adjusted by various parameters among which can be cited the outlet diameter, the fluid viscosity and the roller mass. The closure means may also have a precise regulating valve system capable of varying the flow rate as desired.

FIGS. 6 to 9 illustrates a preferred configuration of the supple pouch of the invention. The pouch has a main portion 25 having adapted for receiving the viscous fluid food product and an outlet portion 23 integrally extending from the main portion. Preferably, the pouch has a main portion comprising the fluid with a substantially constant longitudinal cross-section so as to allow a substantially constant quantity of fluid food to be dispensed according to a predetermined travel of the roller along the pouch. More specifically, the pouch may have a substantially rectangular shape. However, other shapes can also be contemplated as well without departing from the scope of the invention.

The pouch is made by the assembly of two flat films 27, 28 sealed together along a peripheral seam 29. The seam 29 may be closed at the outlet end 230. In an alternative, an in-built closure means can come with the pouch. The films are secured together in a substantially flat configuration so that the thickness of the pouch can be reduced to a minimum value when the dispenser empties the pouch. It must be noted that the position of the outlet as shown is subjected to various modifications. For example, the outlet could be produced in a corner of the main portion. The material of the pouch can be adapted to the type of food and storage conditions. However, preferred films for the pouch have oxygen and water vapor barrier materials. The films are selected among Nylon/EVOH/LLPDE or PP/EVOH/PP or PP/EVOH/LLPDE. Heat sealable films are also preferred. The film thickness can advantageously be comprised between 0.10 mm and 0.15 mm. It is also possible to have the pouch formed of one layer of plastic film properly folded along a foldup portion and sealed along portions of the free edges of the layer.

Figure 10:
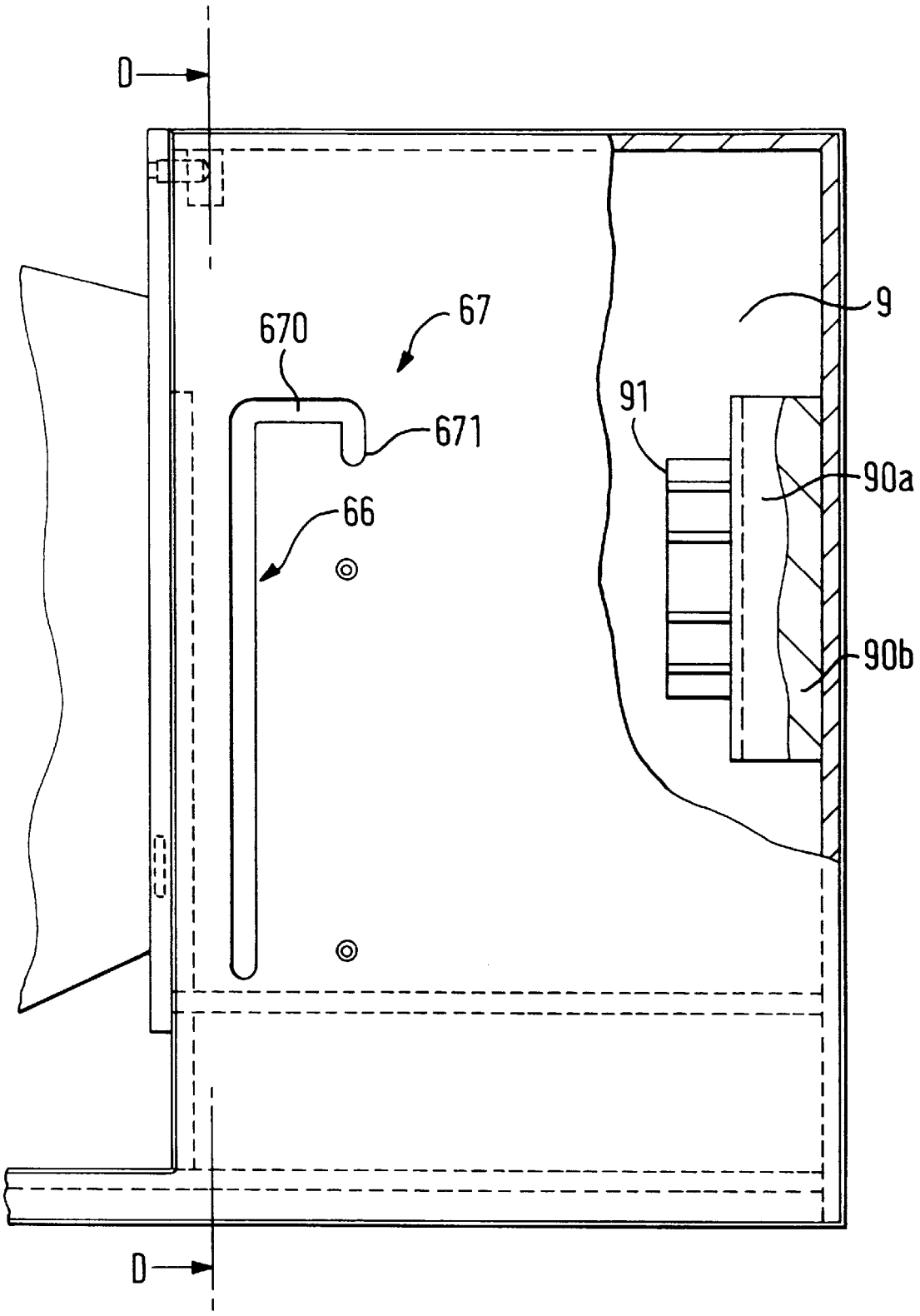
FIG. 10 is a side view of the dispenser according to a variant of the invention.
Figure 11:
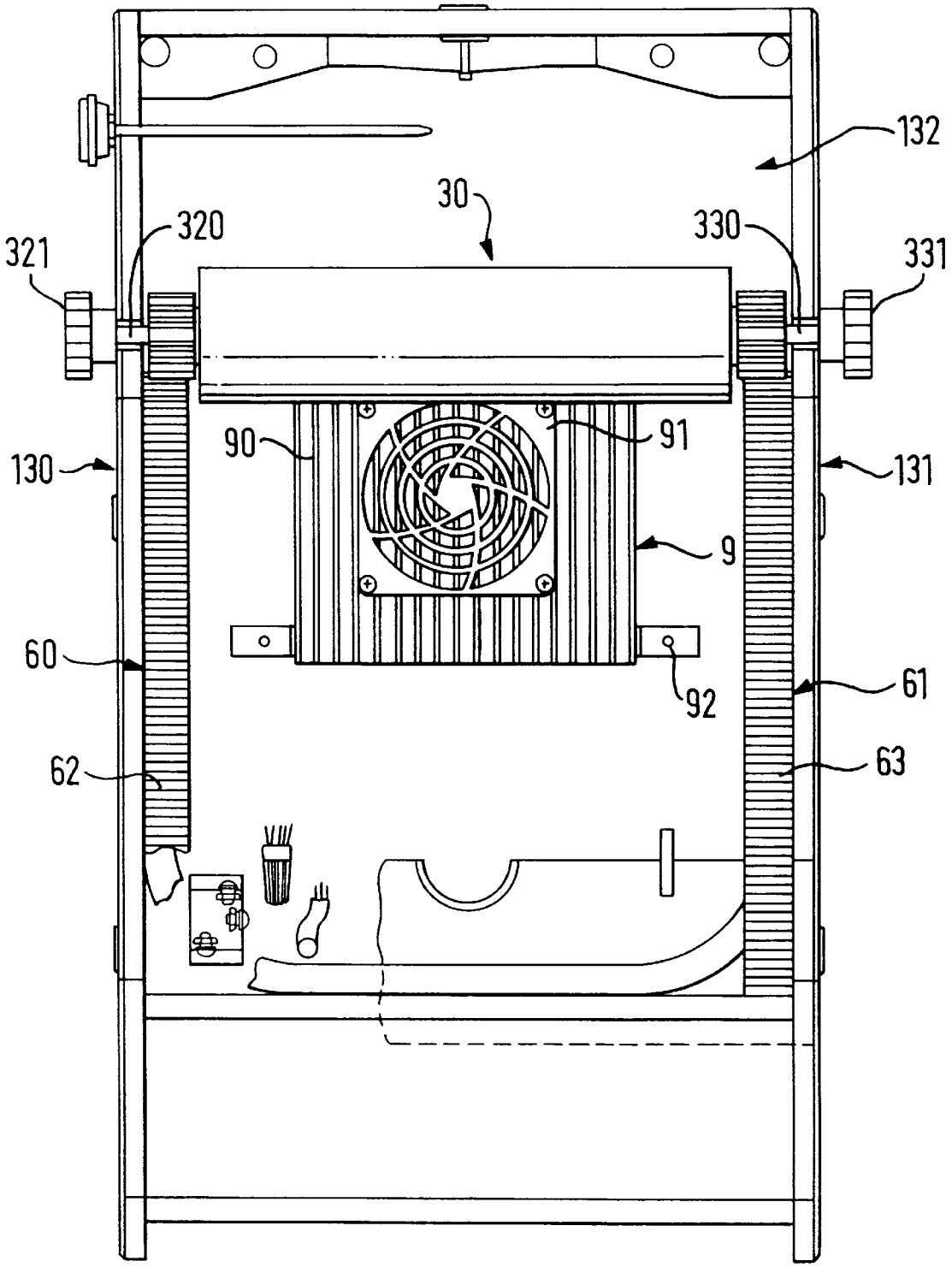
FIG. 11 is a cross-sectional view along line D—D of FIG. 10.
Figure 12:
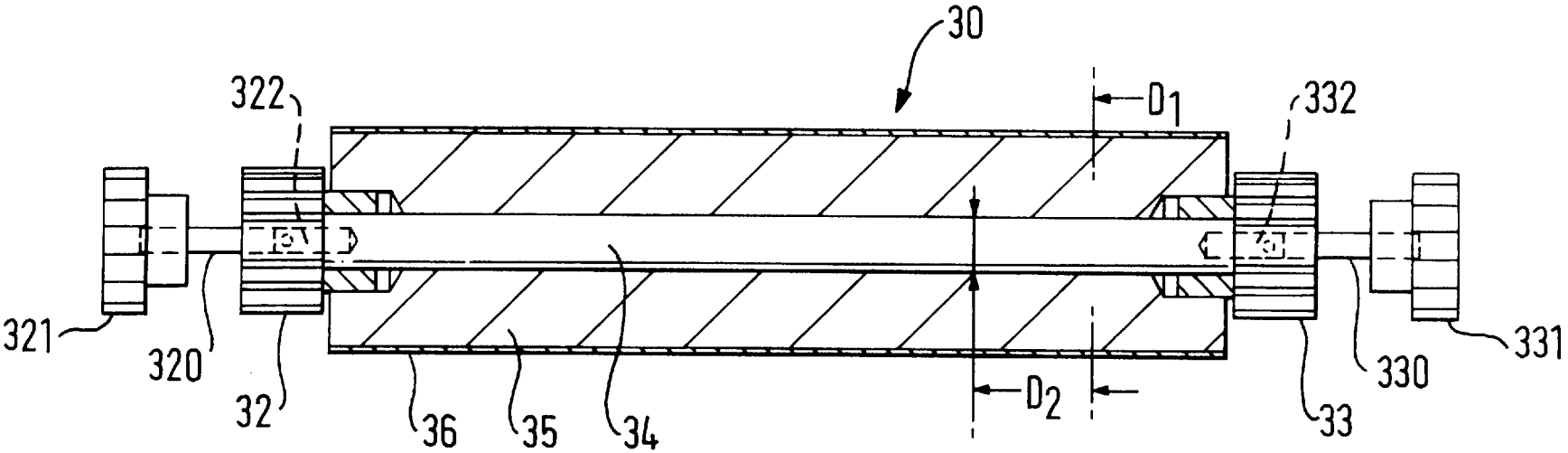
FIG. 12 is a cross-sectional view of the roller according to the embodiment of FIG. 11.

FIGS. 10 to 12 represent another preferred embodiment of the invention in which the roller is further laterally guided by additional guiding means provided on each side of the housing.

More particularly, the side walls 130, 131 of the housing comprise a pair of guiding slots 66 which are vertically oriented and disposed parallel to the gear tracks 62, 63. A pair of axles 320, 330 extends on both sides of the roller body which slidably cooperates through the slotted portions 66 while the roller travels downwardly along the pouch. The vertically oriented portions 66 extend slightly above the upper level of the gear tracks to ensure the disengaging of the roller from the gear tracks when the roller is raised upwardly. The vertically oriented portions also terminate at their upper ends by hook-shaped slotted extensions 67 that provide a retaining means for the roller in a rest position when the housing is opened for replacement of the pouch and installation of a new one. For that the hook-shaped extensions are directed toward the interior of the housing in opposite direction to the opening wall of the housing so as to maintain the roller in a standing-back position with respect to the pouch.

The extensions 67 can be curved or made of slightly rectilinear portions as illustrated in FIG. 10. In all cases, the extensions 67 are shaped in a manner to define a position where the roller is statically maintained in a rest position. For instance, the extensions is a substantially straight horizontal portion 670 which ends by a short vertical recess 671 defining a stable support for the axles. In an alternative (not shown), the extensions are turned outwardly at an angle of at least 180 degrees relative to the vertically extending guide slot portions 66.

The roller 30, as illustrated in FIG. 12, distinguishes from the previous version by the addition of a pair of axles 320, 330 onto which are attached handling member 321, 331 such as knobs or similar prehension means. The handling members are intended to protrude externally along the sides of the housing promoting a convenient manipulation of the roller when raised to the rest position after completion of the descent of the roller. Preferably, the axles 320, 330 are fixedly connected to the main body of the roller by means of removable connection means. For instance, the axle may comprise a threaded portion or rod 322 screwed in a complementary threaded hollow portion of the body of the roller. The side portions 32, 33 of the roller constitute a pair of spur gears having a plurality of teeth, for example 14 teeth, and are mounted on each side of a central shaft 34. A weight portion 35 made of a high-density material surrounds the central portion of the shaft. The surface of the weight portion is preferably covered with a layer or tubing made of a material having good sliding properties so as to reduce the resistance forces with the compressed surface of the pouch. For instance, the layer may be of Teflon material or other materials with relatively low friction constant.

The present dispenser can be built less cumbersome and lighter than the state-of-the-art devices and so can be stored in areas of limited space. For instance, the dimensions of the housing can be 11-inch wide (L), 20-inch tall (W) and 12 to 18-inch deep (d) as shown in FIG. 1. The roller has an external diameter $D_1$ of about 2 inches and inside diameter $D_2$ of about ½ inch and has a weight of about 2 lbs. (FIG. 12). Pouches having overall dimensions of 14 by 10 inches can be easily processed in the dispenser of the invention which otherwise would require conventional dispensers much larger and heavier.

The device may also include means for thermally controlling the pouch at a constant temperature. In the some cases, it is advantageous to raise rapidly and maintain the pouch at a relatively warm temperature as for cheese sauce, tomato sauce or similar. For that, heating elements 9 may advantageously complete the device. The heating elements 9 are installed, as shown in FIGS. 10 and 11, inside the housing, for instance, they are attached to the inner surface of the rear wall 132 of the housing. The heating elements comprise an electrical heat device comprising a heat sink side 90*a* and an electrical resistance cartridge 90*b* on the opposite side (FIG. 10). The resistance cartridge provides by conduction a certain amount of heat to the heat sink side. Heat accumulated by the heat sink is distributed in the housing by means of an air circulating means such as a fan 91. The fan helps the housing to be constantly maintained at a substantially homogeneous temperature and it favors dry hot air circulation inside the housing. In that case, heating of the pouch is mainly produced by convection. The resistance cartridge could be replaced by other heating sources such as resistance strips, for instance.

Figure 13:
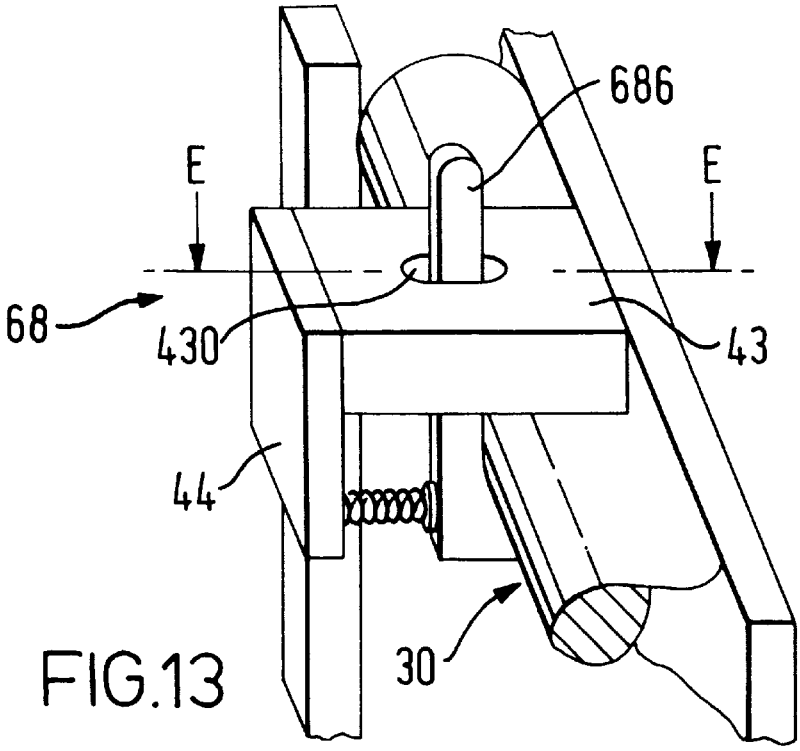
FIG. 13 is a fragmentary perspective view of a release mechanism in a variant of the invention.
Figure 14:
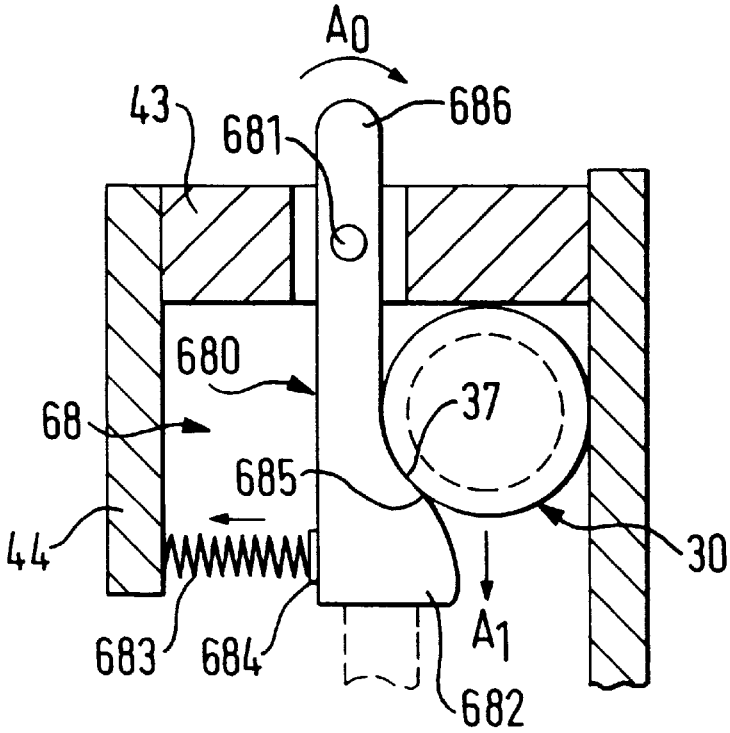
FIG. 14 is a cross-sectional view taken along line E—E of the release mechanism of FIG. 13.

Referring now to FIGS. 13 and 14 showing another embodiment of the invention, the roller 30 is secured at the upper end of the dispenser by a release mechanism 68 so that the dispenser can be opened for replacement of the pouch while the roller is secured at a start position. When the dispenser is closed, the release mechanism is activated which causes the roller to go. The release mechanism 68 comprises a lever member 680 which is engaged through an elongated hole 430 of the upper wall 43 of the housing. The lever 680 is further rotatably mounted on the upper wall 43 of the housing by means of a hinge 681 transversely crossing the elongated hole. At its lower end, the lever member is provided with a base portion 682 of enlarged section which retains the roller 30 in its upper secured position. The base portion 682 is elastically urged against the roller by means of an elastic member 683, such as a coil spring, which acts in extension between a fixed portion of wall 44 and the rear surface 684 of the lever member. In the retaining position illustrated in FIGS. 13 and 14, a cylindrical portion 37 of the roller comes into abutment with a complementary engaging shaped surface portion 685 of the lever. The roller is released by hand actuation of the upper externally protruding portion 686 of the roller in direction of arrow $A_0$, i.e., in front direction, so as to cause the elastic member 683 to compress sufficiently and so to have the base portion 682 of the lever moved in disengaged rear rotational position. In absence of the abutting surface 685, the roller is allowed to move by gravity, in direction $A_1$, along the side gear tracks. Displacement of the lever in direction as shown is made possible while the housing is fully closed.

Figure 15:
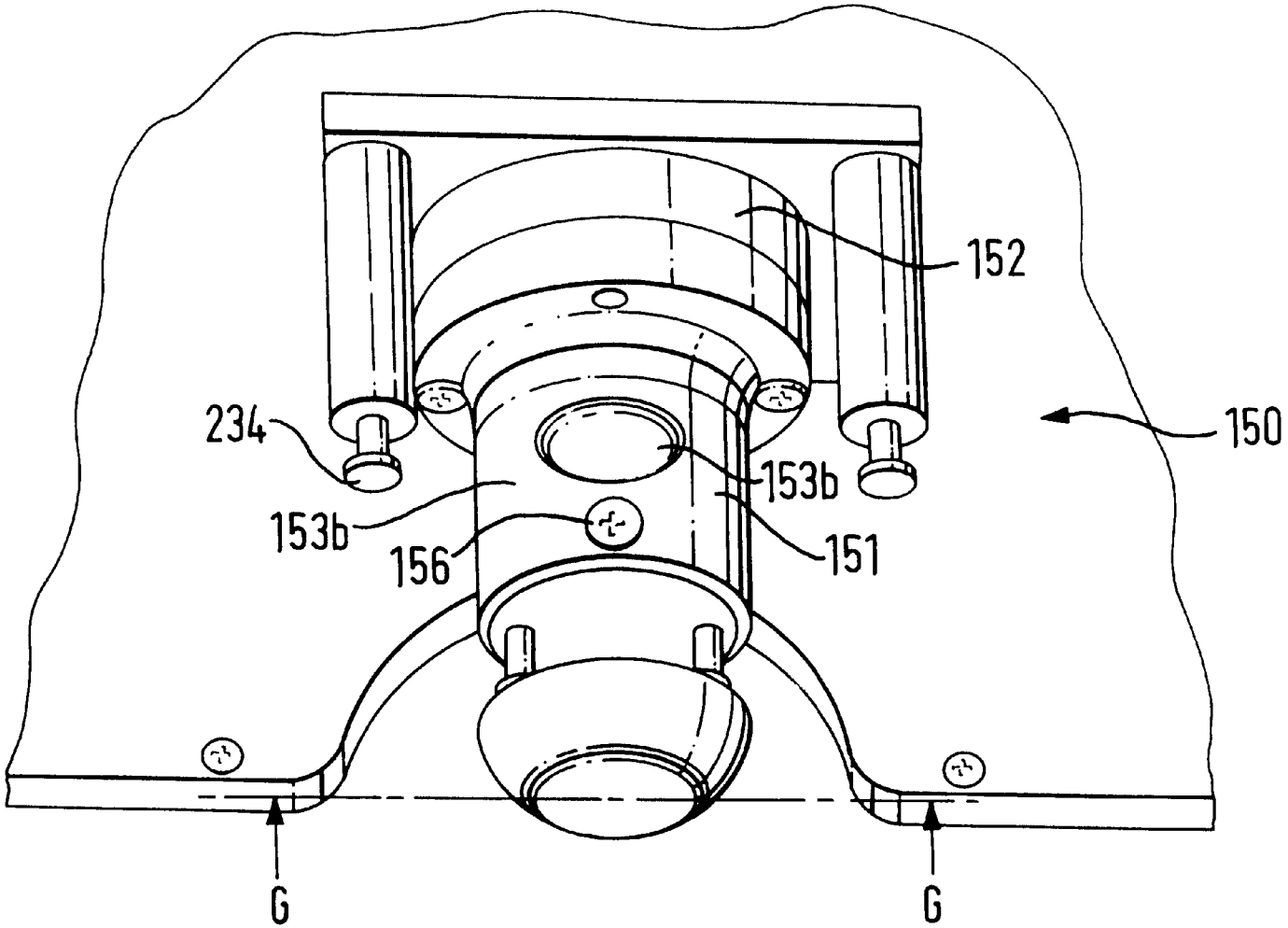
FIG. 15 is a perspective view of a pinch valve means according to an embodiment of the invention.
Figure 17:
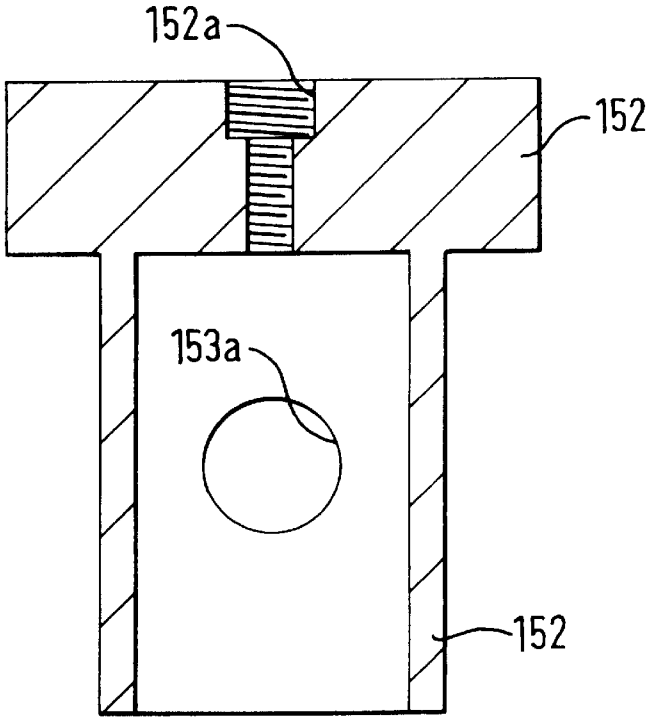
FIG. 17 is a cross-sectional view similar to FIG. 16 of a part of the pinch valve means.
Figure 16:
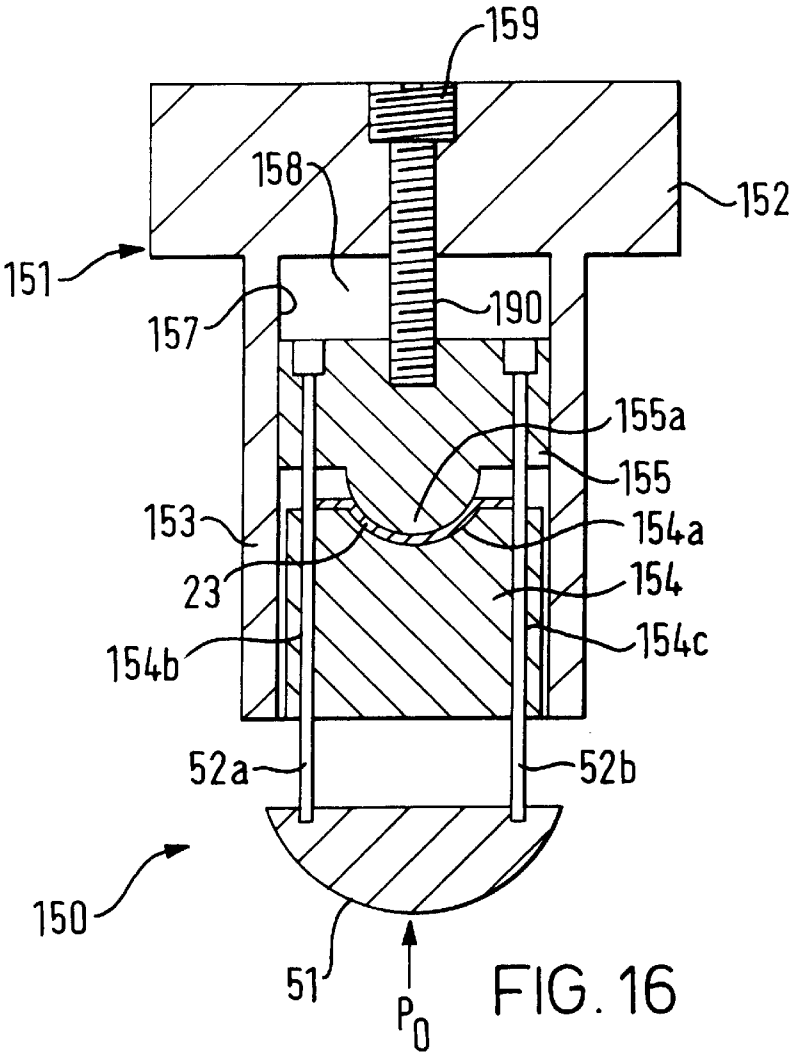
FIG. 16 is a longitudinal cross-sectional view along line G—G of FIG. 15 of the pinch valve means.
Figure 18:
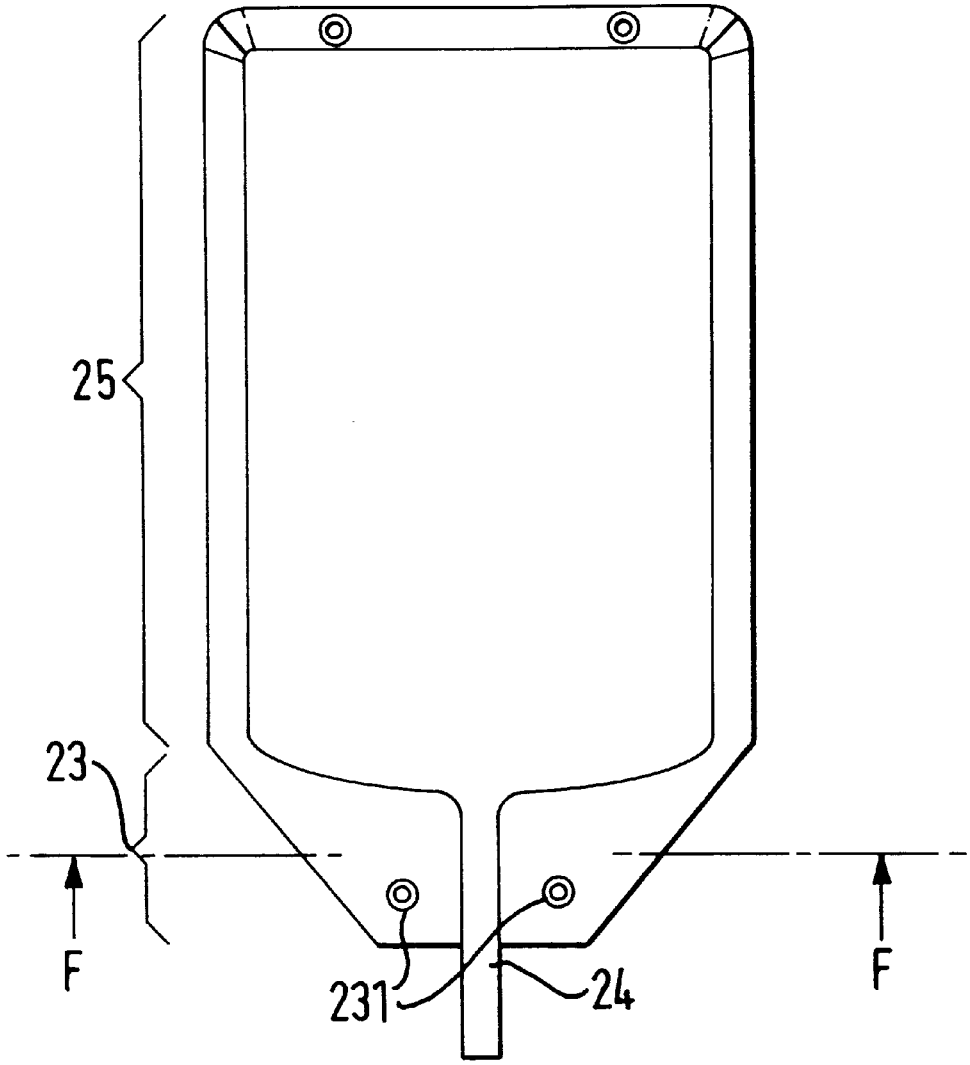
FIG. 18 is a front view of a pouch according to an embodiment of the invention.
Figure 19:
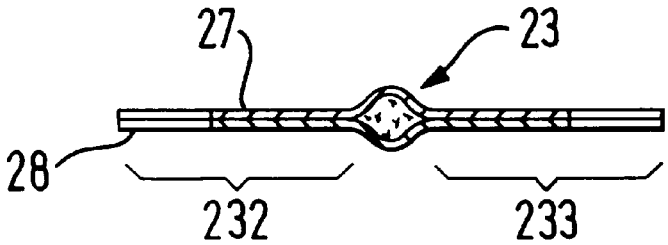
FIG. 19 is a cross-sectional view of the pouch of FIG. 18 along line F—F.
Figure 20:
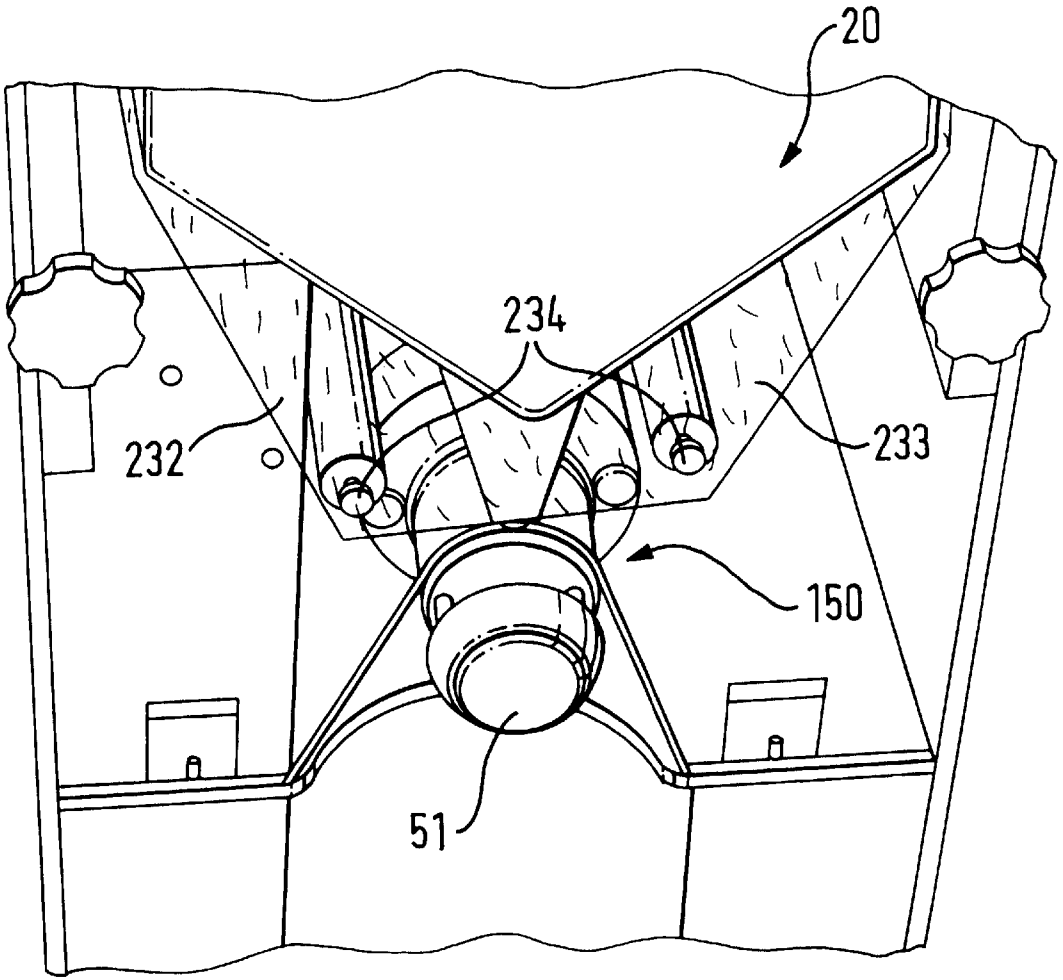
FIG. 20 is a fragmentary perspective view of the bottom of the dispensing device corresponding to FIGS. 15 to 19.

FIGS. 15 to 20 illustrate a variant of the invention in which the closure means is more specifically configured to receive a pouch according to FIGS. 18 and 19. The combination of the valve and the pouch is shown in FIG. 20. The closure means 150 comprises a main base 151 attached by its rear portion 152 to the housing of the dispensing device. Main base 151 extends horizontally from the rear portion 152 by a substantially tubular collar 153. Collar 153 and rear portion 152 can be made monobloc or alternatively, be made of separate parts connected together by suitable attaching means such as screws, rivets, gluing or equivalents. Collar 153 has an internal cylindrical housing 157 for receiving a pinch assembly comprising an abutting member 154 and a pressure member 155. Abutting member 154 is removably attached to collar 153 by removable connections such as a radially oriented screw 156. When cleaning of the closure means is needed, the abutting member 154 can be separated from main base 151 to allow access to the inner of housing 157 and pressure member 155. Pressure member 155 is slidably mounted in housing 157. A predetermined space 158 is designed to allow a sufficient stroke of pressure member inside housing 157. Collar further has a lower aperture 153*a* located under the pinch assembly to serve as a passage for the outlet portion of the pouch (FIG. 17). Similarly, an upper aperture 153*b* is provided at the top of collar 153 as shown in FIG. 15 to permit engagement of the lower outlet portion of the pouch therethrough.

Pressure member 155 is connected to main base 151 by a rear resiliable means 190. For that, pressure member 155 is spring biased by resiliable means, such as compression spring 190, causing pressure member 155 to compress against abutting member 154. The degree of pressure is made controllable by means of an adjustable control member 159 which provides an adjustable prestressing to the resiliable means. For instance, control member 159 is screw member threaded within a counterbore 152*a* provided at the back of rear portion 152. A clockwise oriented motion of control member 159 will result in a greater degree of compression on the pressure member, i.e., on the pouch.

Abutting member 154 and movable pressure member are complementary shaped to receive the lower portion or outlet portion 23 of the pouch in-between. Preferably, a rounded end 155*a* terminates pressure member 155 which engages a complementary shaped rounded end 154*a* of abutting member. Rounded portions provide a good squeezing effect to the pouch while preventing any risks of puncturing the outlet portion of the pouch.

Connection of pressure member 155 to a handling knob 51 is made possible by means of a pair of connecting rods 52*a,* 52*b* slidably mounted through elongated bores 154*b,* 154*c* of abutting member 154. Rods 52*a,* 52*b* fixedly connect knob 51 to pressure member 155. The connection to pressure member can be made by any suitable means at capabilities of a man skilled in the art. As will be also appreciated, the length of rods 52*a,* 52*b* will be determined to achieve the desired length-dispensing stroke.

The dispensing mode occurs when handling knob 51 is pushed to a sufficient force value in pushing direction $P_0$ which causes the pressure member to force the resiliable means 190 to compress to a certain extent. Pressure member is caused to move rearwardly in longitudinal direction within housing 157 so that the relative spacing between rounded portions 154*a,* 155*a* increases. The stored potential energy due to the roller load causes the food product to flow between pressure and abutting member. The return stroke is then caused by release of the force exerted upon handling knob 51. Lower portion 23 of the pouch is so pinched closed to restrict the further flow of fluid through the valve passage. Closure of the valve assembly causes the roller to stop its gravity fall along the pouch until a next pressure pulse is applied onto the knob 51.

FIGS. 18 to 20 illustrate another variant of the fitmentless pouch. The pouch distinguishes from the one of FIGS. 8 and 9, by its lower portion or outlet 23 which is designed to provide additional hanger means 231. For that, the films 27, 28 of the pouch are attached at tubular segment 24 along substantial side layered portions 232, 233 on each side of the outlet 23. Holes 231 are provided through surface 232, 233. Holes can be reinforced against tearing by rigid rings or similar means. Holes 231 are spaced apart a distance determined by the distance separating two complementary hanger means, such as elongated pins 234 attached to the bottom part of the housing as illustrated in FIGS. 15 or 20.

FIG. 20 shows the pinch valve mechanism 150 loaded with a pouch 20 of the invention. The maximum quantity of fluid which is dispensed by one stroke can be predetermined by choosing an appropriate inner section of the lower portion of the pouch or outlet portion in the region of the passage through the valve means. The actual quantity of fluid dispensed depends on the degree of pressure applied on the closure means. The possibility to control the flow is given to a certain extent to the consumer by control of the stroke length in actuating the handling knob 51.

Figure 21:
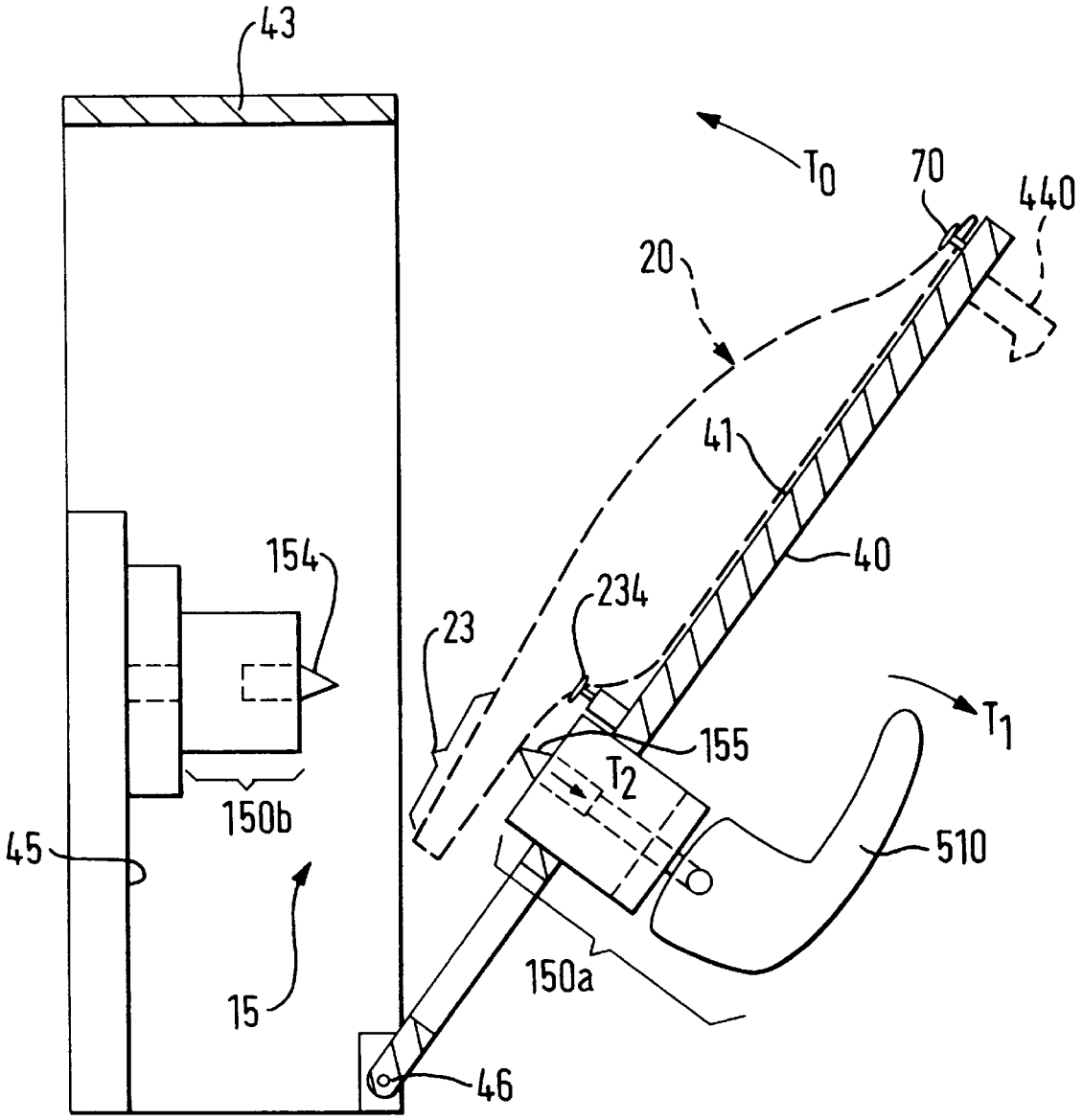
FIG. 21 is a diagrammatic side view of a dispenser of the invention according to another possible variant.
Figure 22:
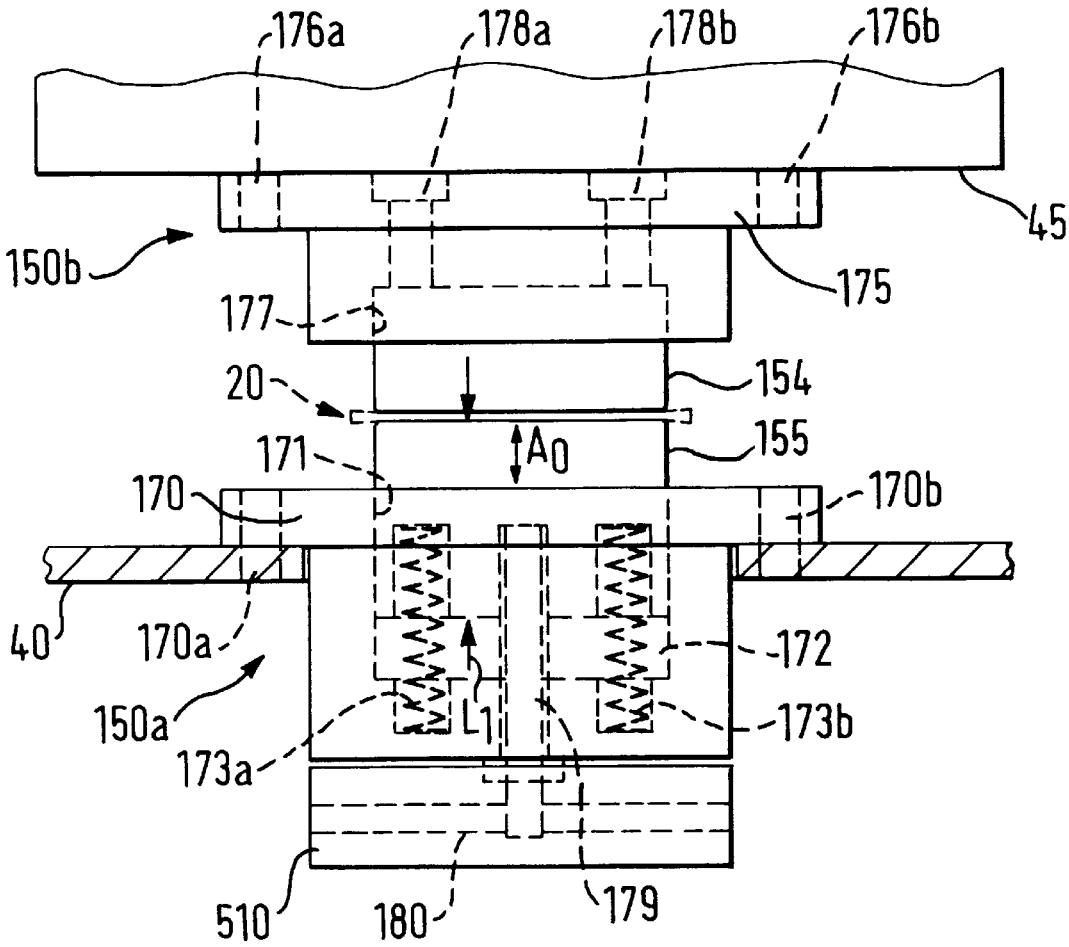
FIG. 22 is a diagrammatic transversal view of the valve or closure means of FIG. 21.

FIGS. 21 and 22 illustrate another variant of the invention in which the device is openable in a manner that allows the pouch 20 to be installed more rapidly and efficiently. For that, the dispenser comprises a first openable panel, for instance front door 40 and a fixed panel to the dispenser, for instance a rear non-openable panel 45. Rear panel 45 can be the rear wall of the dispenser or a separate panel fixedly attached into the housing. Openable panel 40 is movable with respect to fixed panel 45 by means of hinge means 46 connected to a fixed part of the housing. Preferably, the hinge means 46 is located at the bottom of front panel 40 so that the front panel is openable from above by pulling handle 440, for instance. The advantageous feature of this arrangement resides in the separation of the valve or closure means 15 into a first half-valve sub-assembly 150*a* attached to the openable or movable panel 40 and a second half-valve sub-assembly 150*b* attached to the fixed panel 45. Each half-valve sub-assembly comprises pinching members 154, 155 arranged in a face-to-face relationship when the movable panel 40 is rotated in direction of closure To. When movable panel is opened, it rotates along axes 46 which causes pinching member 155 to move away along an angular path. Pinching members are respectively, a static abutting member 154 and a spring biased pressure member 155. Static abutting member is preferably attached indirectly to fixed panel while spring biased pressure member 155 is attached in a retractable manner to movable panel 40.

FIG. 22 shows in detail the valve arrangement when assembled after closure of the movable panel 40. First subassembly 150*a* comprises a base portion 170 connected to movable panel 40 by fixed connection means 170*a,* 170*b*. A transversely oriented opening 171 is provided in base portion 170 which receives pressure member 155. Opening 171 has a depth larger than the length "$l_1$" of member 155 so as to create sufficient room 172 to allow pressure member to slide in longitudinal direction $A_0$ upon actuation of lever 510. A pair of compressive springs 173*a,* 173*b* are positioned between member 155 and the bottom of opening 171, preferably in two pairs of opposite seats provided respectively in the bottom of opening 171 and in the bottom of pressure member 155. These resilient members 173*a,* 173*b* have the function of maintaining sufficient pressure on pressure member to constantly force pressure member 155 against abutting member 154 of the second half sub-assembly 150*b* in absence of counter-force exerted by actuation of lever 510. In the center of pressure member is provided a central connection with lever 510 via a protruding rod 179 which is integral part of pressure member 155. The protruding rod is secured to lever 510 via dowel 180.

In an alternative, the manual actuating system 510 could be replaced by a portion control device comprising solenoid means controlled by a timer for delivering a pre-set portion of fluid through the valve means (not shown).

Second half-valve sub-assembly 150*b* comprises a base portion 175 fixedly attached to rear panel 45 by connection means 176*a,* 176*b*. A central elongated opening 177 extending transversely provides a close seat to abutting member 154. Connecting means 178*a,* 178*b* further secure abutting member 155 in seat 177.

A movable panel 40 is provided with means 70, 234 for attaching the pouch in a position adjacent the interior surface 41 of the movable panel. The location of means 70, 234 is determined so that the outlet portion 23 comes between the two pinching members 154, 155. In a closure position where the movable panel is fully rotated in direction $T_0$ so as to come in abutment with the top wall 43 of the dispenser, the pinching members 154, 155 exerts a sufficiently high pinching effect on the pouch to prevent any flow of fluid through the outlet of the pouch.

As shown in FIG. 21, the half-valve subassembly 150*a* comprises a lever 510 resiliably connected to pressure member 155 which acts, in rotational direction $T_1$, for retracting the pressure member in rearward direction $T_2$ when dispensing mode is desired. It must be further noted that the self-disengaging arrangement of FIGS. 21 and 22 could be implemented independently in other types of dispensing device using pressure systems different from roller means.

Figure 23:
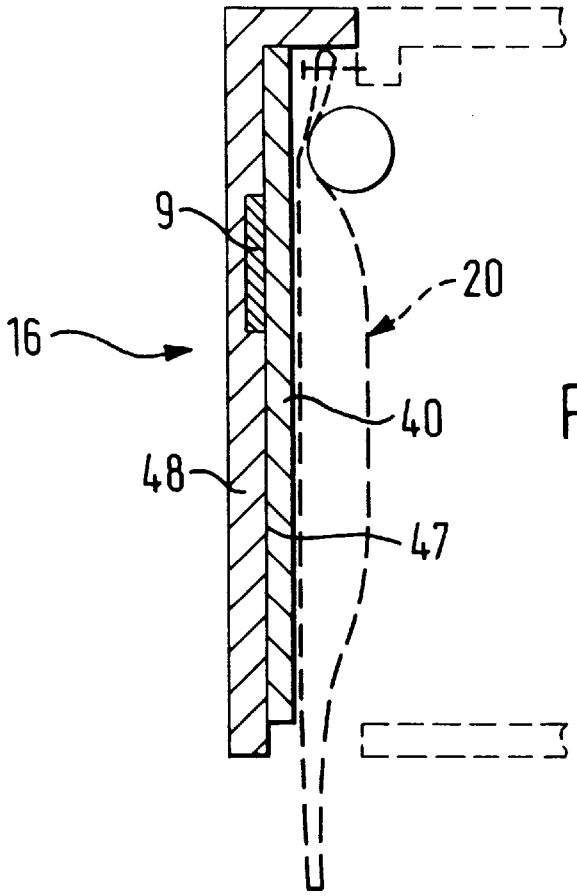
FIG. 23 is a diagrammatic partial cross-sectional view of the dispensing apparatus comprising a heating device.

In an embodiment illustrated in FIG. 23, the heating means may be applied by conduction effect to the pouch. For that, the planar surface 40 contacting the pouch can be thermally coupled to appropriate heating means 9. Heat is so provided by the constant contact of the pouch with the thermally conductive plate 40. Heating means 9 are preferably electrical resistance elements contacting the planar surface. The heating device may be adhesively attached on the outer side 47 of the planar surface 40. As illustrated, the heating element 9 may also be inserted between the planar surface 40 and a heat insulated external wall 48. The heating element is preferably of a size and power sufficient to properly and rapidly heat the planar surface. The heating element may preferably extend on the planar surface to about the same length as the planar surface or alternatively, may cover only partially the planar surface. Planar surface 40 and external wall 48 can form, for instance, the front door 16 of the dispensing device.

The heating device may comprise adhesive strips or bands and electrical resistive elements connected therewith such as wires, mat or equivalents.

The roller also promotes the contact and so heat transfer from the plate to the pouch. The roller surface may be covered by a thermally insulated material to prevent or reduce caloric loss in direction to the roller. In another alternative, the roller can also be thermally regulated.

The conduction means can be employed either alone or to supplement the convection means as previously described in FIG. 10 and FIG. 11. Tests have permitted to prove that the use of the combination of both heating modes could dramatically reduce the time necessary to set the temperature of the pouch at the right desired value from a cold pouch. For example, cheese sauce pouch or chili pouch of 6 LB can be heated up from 70° F. to 140° F. using air convection mode only that would take approximately 1,000 watts to heat the product in about 120 minutes. A pouch of the same size could be heated up to the same temperature of 140° F. using air convection and conduction mode, as previously described, that would need about 500 watts at the air heater and about 360 watts at the plate heater for a total of about 860 watts to increase the energy utilization by about 14%. If a 500-watt air heater and 500-watt conduction plate heater for a total of 1000 watts is used, the product would be heated in about 100 minutes only instead of 120 minutes.

Figure 24:
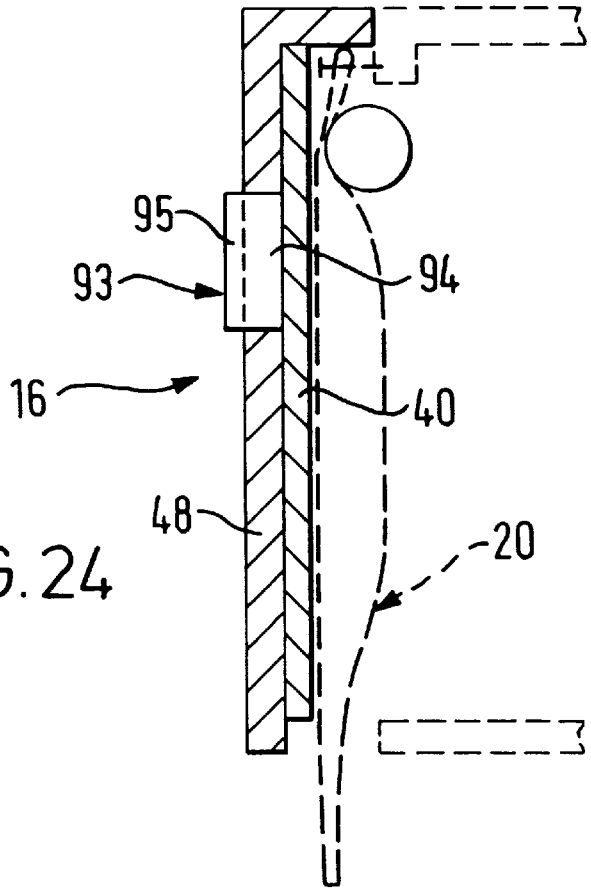
FIG. 24 is a diagrammatic partial cross-sectional view of the dispensing apparatus comprising a cooling device.

In another embodiment illustrated in FIG. 24, the pouch may need to be cooled such as for certain refrigerated food product. For that, the heating means may be replaced by cooling means such as TEC's (Thermoelectric coolers) which permits regulated cold dispensing. The TEC 93 has a cold side 94 and a heat sink side 95. The TEC is formed as a thermopile by connecting in series a plurality of thermocouples in a known manner: each thermocouple consisting of a p-type semiconductor and a n-type semi-conductor electrically connected between two poles of a direct-current power supply to produce a cool junction on the cold side 94 and a warm junction on the heat sink side 95. The TEC is also known as a thermoelectric module, a Peltier cooler or a thermoelectric heating/cooling device. In the context of the present invention, the cold side 94 TEC would be preferably coupled directly (as shown) or indirectly via a buffer block (not shown) to the planar surface 40 which contacts the pouch 20 so as to provide conduction cooling of the pouch. Dissipation of the heat coming from the heat sink side is preferably achieved to atmosphere. The heat conductive plate 40 is preferably insulated from outside by an insulated external wall 48 comprising resin material having good insulation properties.

While the invention has been described with regard to specific embodiments, it should be noted that modifications might be made without departing from the scope of the invention.

What is claimed is:

1. A dispenser for a viscous fluid food product, the dispenser comprising:

a supple pouch having first and second ends, a sidewall that can be arranged to form first and second opposed surfaces, and an outlet, the pouch containing a viscous fluid food product therein;

a housing configured and dimensioned for receiving the pouch;

a roller having a pressing surface disposed in free pressing engagement with the first surface of the pouch so as to constantly put the pouch under pressure by effect of the weight of the roller so as to urge the viscous fluid food product content toward the outlet and a planar surface disposed adjacent the second surface of the pouch, a closure independent from the pressing roller engaged with the outlet for closing the outlet, the closure being capable of opening the outlet to release the pressure in the pouch and thereby cause the roller to move by gravity effect along the pouch surface toward the outlet by gravity for expelling the viscous fluid food product through the outlet.

2. A dispenser according to claim 1, wherein the planar surface is substantially vertically arranged along at least a major portion of the sidewall surface of the pouch, the roller contacts the pouch at the first end, and the pouch outlet is positioned at the second end of the pouch.

3. A dispenser according to claim 2, wherein the planar surface constitutes an interior surface of at least a portion of a wall of the housing.

4. A dispenser according to claim 3, wherein the planar surface further forms at least a portion of an openable door in the housing.

5. A dispenser according to claim 1, wherein the housing includes two guide means for guiding the roller, with the roller having two side portions closely engaged with the guide means, and the pouch being positioned between the guide means.

6. A dispenser according to claim 5, wherein the guide means are disposed at a certain distance parallel to the planar surface for causing the roller to constantly apply a force upon the pouch and against the plate surface.

7. A dispenser according to claim 6, wherein the guide means comprise two gear tracks along which are complementary arranged two gearing cylindrical portions forming the two side portions laterally protruding from the pressing surface of the roller.

8. A dispenser according to claim 7, wherein the roller is positioned in a freely rotating arrangement along the two gear tracks without connection means.

9. A dispenser according to claim 1 wherein the closure means comprises a clamping assembly for selectively providing a pinching force upon the outlet of the pouch and for releasing the pinching force to open the outlet and control the dispensing of the viscous liquid food product therefrom.

10. A dispenser according to claim 9 wherein the outlet comprises a narrowed portion forming a substantially tubular segment protruding downwardly from the second end of the pouch and along which is attached the closure means.

11. A dispenser according to claim 10, wherein the clamping assembly comprises a clamping member and an abutting member resiliably engaging the narrowed portion.

12. A dispenser according to claim 9, wherein the clamping assembly comprises a first half-valve sub-assembly attached to an openable portion of wall of the housing and a second half-valve sub-assembly attached to a fixed portion of wall of the housing; each sub-assembly comprising one pinching member, the pinching members being arranged together in a face-to-face relation when the openable portion is in closure position and the pinching members being spaced apart an angular segment when the openable portion is in opened position.

13. A dispenser according to claim 12, wherein the pouch has a main portion comprising the fluid with a substantially rectangular shape.

14. A dispenser according to claim 12, wherein the pouch comprises two flat supple films connected in a substantially flat configuration together by a peripheral seam.

15. A dispenser according to claim 1 wherein the pouch has a substantially constant longitudinal cross-section so as to allow a substantially constant quantity of viscous fluid food product to be dispensed according to a same predetermined travel of the roller along the pouch.

16. A dispenser according to claim 1 wherein the housing further comprises means for hanging the pouch in a position so that the pouch is substantially adjacent to the plate surface before the roller is installed in the housing.

17. A dispenser according to claim 16, wherein the pair of guiding slots extend upwardly by hook-shaped extensions which confer a stable rest position for the roller.

18. A dispenser according to claim 1, wherein the housing further comprises a pair of guiding slots which are substantially vertically oriented and the roller comprises a pair of axles slidably engaged through the pair of guiding slots when the roller moves downwardly along the pouch.

19. A dispenser according to claim 1, wherein the roller is secured at an upper position in the housing by means of a release mechanism which comprises a resiliently urged lever having an externally protruding portion and an enlarged base portion against which the roller abuts.

20. A dispenser according to claim 1, wherein the planar surface is thermally coupled to a heating or cooling device which provides thermic transfer to the planar surface for heating or cooling the viscous liquid food product in the pouch.

21. A dispenser according to claim 20, wherein the heating or cooling device comprises a combination of conduction and convection heating or cooling means.

22. A dispenser according to claim 20, wherein the planar surface is coupled to a heating device comprising electrical resistance elements adhesively attached to the planar surface.

23. A dispenser according to claim 20, wherein the planar surface is coupled to a TEC component comprising a cold side which provides cooling by conduction to the planar surface.

24. A viscous liquid food product pouch designed for used in the dispenser of claim 1, wherein the pouch comprises a main portion adapted for receiving a food viscous fluid, and an outlet portion integrally extending from the main portion, with the main portion and the outlet portion being formed of at least one layer of plastic film securely sealed along at least a portion of a peripheral seam in a substantially flat configuration.

25. A pouch according to claim 24 wherein the viscous fluid food product is a cheese sauce, tomato sauce, gravy, salad dressing, mustard, mayonnaise, ketchup, cream, Mexican sauce or salsa, condiment, nutritional supplement and concentrate, ice cream, or partly frozen beverage.

26. A pouch according to claim 24, wherein the viscous fluid food product is a fluid comprising suspendable particles up to 12.7 mm in diameter.

27. A dispenser according to claim 1, wherein the roller pressing surface disposed in free pressing engagement with the first surface of the pouch is uninterrupted, so as to constantly not leave a channel where food product in the pouch is bypassed.

* * * * *